US009102169B2

(12) United States Patent
Kurihara

(10) Patent No.: US 9,102,169 B2
(45) Date of Patent: Aug. 11, 2015

(54) IMAGE FORMING APPARATUS

(75) Inventor: Masashi Kurihara, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 345 days.

(21) Appl. No.: 12/957,275

(22) Filed: Nov. 30, 2010

(65) Prior Publication Data

US 2011/0293310 A1 Dec. 1, 2011

(30) Foreign Application Priority Data

May 26, 2010 (JP) ..... 2010-120745

(51) Int. Cl.
*B41J 2/165* (2006.01)
*B41J 3/60* (2006.01)

(52) U.S. Cl.
CPC ..... *B41J 3/60* (2013.01)

(58) Field of Classification Search
CPC ..... B41J 3/60
USPC ..... 399/72; 347/35
See application file for complete search history.

(56) References Cited

U.S. PATENT DOCUMENTS 5,488,458 A 1/1996 Benedict
5,875,383 A 2/1999 Stemmle
6,108,513 A * 8/2000 Landa et al. ..... 399/384
6,966,712 B2 * 11/2005 Trelewicz et al. ..... 400/76
2009/0067911 A1 3/2009 Matsuhashi
2009/0138765 A1 * 5/2009 German ..... 714/57
2009/0189928 A1 * 7/2009 Ino et al. ..... 347/1

FOREIGN PATENT DOCUMENTS

CN 101578180 A 11/2009
EP 2000315 A1 12/2008
JP H11-192730 A 7/1999
JP 11-249346 A * 9/1999
JP 2008-036825 A 2/2008
JP 2008-126530 A 6/2008
JP 2009-078409 A 4/2009
WO 2009/005766 A2 1/2009

OTHER PUBLICATIONS

English machine translation of JP 11-249346.*

* cited by examiner

*Primary Examiner* — Manish S Shah
*Assistant Examiner* — Jeffrey C Morgan
(74) *Attorney, Agent, or Firm* — Canon USA, Inc., IP Division

(57) ABSTRACT

An image forming apparatus includes a control unit arranged to control an image forming unit so as to form images based on image information and to form maintenance images for maintaining the image forming unit. The control unit is arranged to control the image forming unit so as to form images on the second side of the sheet after forming images on the first side of the sheet, and so as to form the maintenance images on the second side at positions such that the maintenance images do not overlap with the images based on the image information formed on the first side.

30 Claims, 10 Drawing Sheets

FIG. 6A
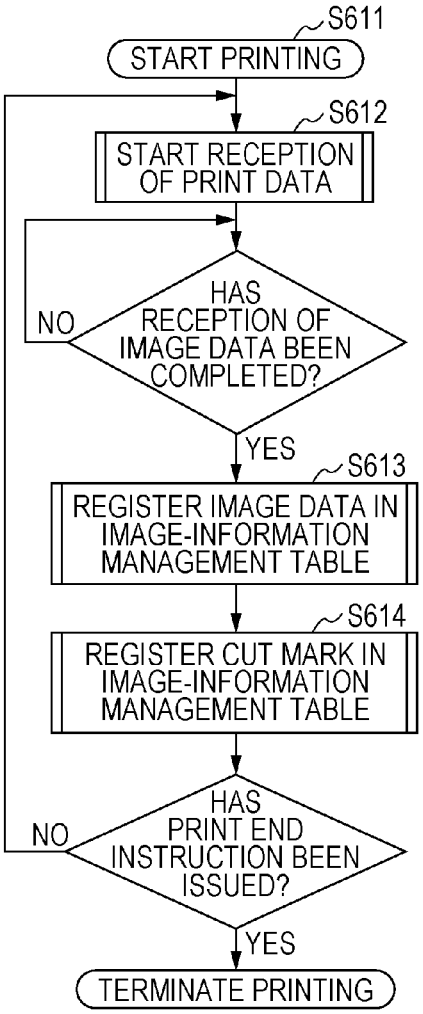
FIG. 6B
| IMAGE PATTERN | NUMBER OF PIXELS |
|---|---|
| IMAGE 1 | 200 |
| CUT MARK | 10 |
| IMAGE 2 | 200 |
| CUT MARK | 10 |
| IMAGE 3 | 200 |
| CUT MARK | 10 |
| IMAGE 4 | 200 |
| CUT MARK | 10 |
| IMAGE 5 | 200 |
| CUT MARK | 10 |
| IMAGE 6 | 200 |
| CUT MARK | 10 |
| IMAGE 7 | 200 |
| CUT MARK | 10 |
| IMAGE 8 | 200 |
| CUT MARK | 10 |
FIG. 6C
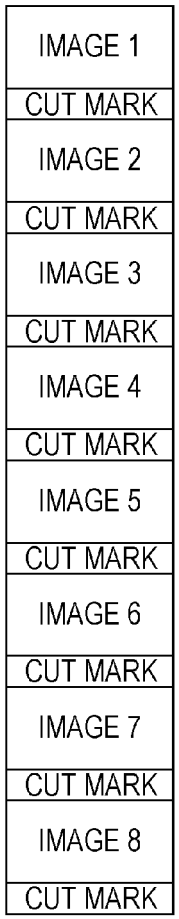

FIG. 7A

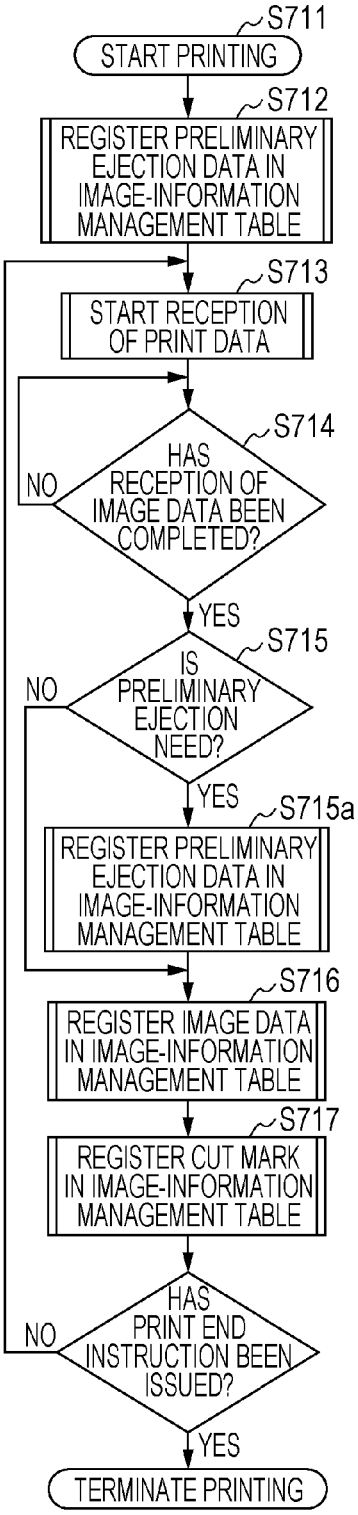

FIG. 7B

S721

| IMAGE PATTERN | NUMBER OF PIXELS | CUMULATIVE NUMBER OF PIXELS |
|---|---|---|
| PRELIMINARY EJECTION | 20 | – |
| IMAGE 1 | 200 | 200 |
| CUT MARK | 10 | 210 |
| IMAGE 2 | 200 | 410 |
| CUT MARK | 10 | 420 |
| IMAGE 3 | 200 | 620 |
| CUT MARK | 10 | 630 |
| PRELIMINARY EJECTION | 20 | – |
| IMAGE 4 | 200 | 200 |
| CUT MARK | 10 | 210 |
| IMAGE 5 | 200 | 410 |
| CUT MARK | 10 | 420 |
| IMAGE 6 | 200 | 620 |
| CUT MARK | 10 | 630 |
| PRELIMINARY EJECTION | 20 | – |
| IMAGE 7 | 200 | 200 |
| CUT MARK | 10 | 210 |
| IMAGE 8 | 200 | 410 |
| CUT MARK | 10 | 420 |

FIG. 7C

| |
|---|
| PRELIMINARY EJECTION |
| IMAGE 1 |
| CUT MARK |
| IMAGE 2 |
| CUT MARK |
| IMAGE 3 |
| CUT MARK |
| PRELIMINARY EJECTION |
| IMAGE 4 |
| CUT MARK |
| IMAGE 5 |
| CUT MARK |
| IMAGE 6 |
| CUT MARK |
| PRELIMINARY EJECTION |
| IMAGE 7 |
| CUT MARK |
| IMAGE 8 |
| CUT MARK |

FIG. 9A

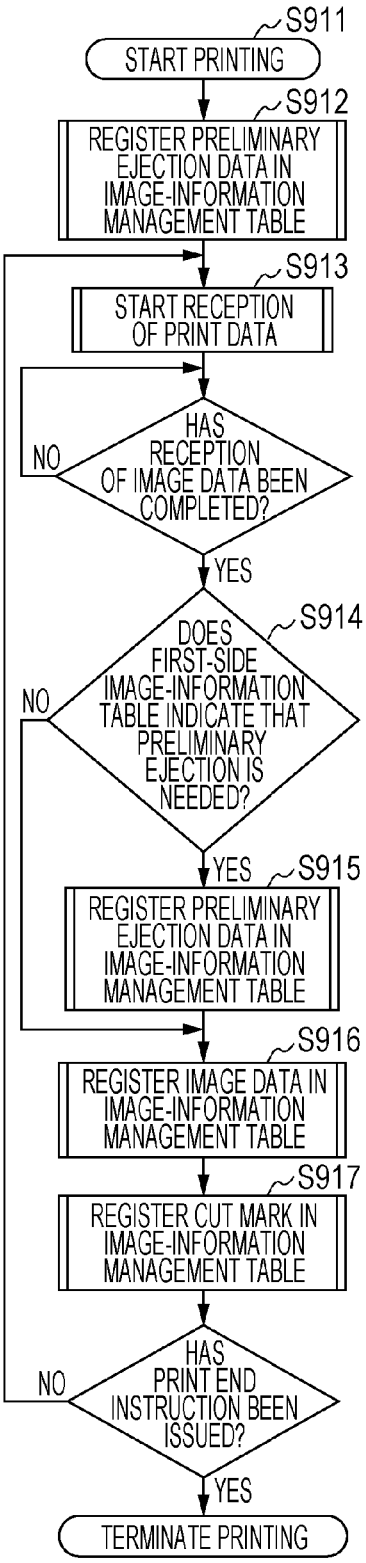

FIG. 9B

| IMAGE PATTERN | NUMBER OF PIXELS | CUMULATIVE NUMBER OF PIXELS | |
|---|---|---|---|
| PRELIMINARY EJECTION | 20 | – | |
| IMAGE 9 | 200 | 220 | |
| CUT MARK | 10 | 210 | |
| IMAGE 10 | 200 | 430 | |
| CUT MARK | 10 | 440 | |
| PRELIMINARY EJECTION | 20 | – | |
| IMAGE 11 | 200 | 220 | |
| CUT MARK | 10 | 210 | |
| IMAGE 12 | 200 | 410 | |
| CUT MARK | 10 | 420 | |
| IMAGE 13 | 200 | 620 | |
| CUT MARK | 10 | 630 | S930 |
| PRELIMINARY EJECTION | 20 | – | |
| IMAGE 14 | 200 | 220 | S920 |
| CUT MARK | 10 | 210 | |
| IMAGE 15 | 200 | 410 | |
| CUT MARK | 10 | 420 | |
| IMAGE 16 | 200 | 620 | |
| CUT MARK | 10 | 420 | |

FIG. 9C

| IMAGE PATTERN | NUMBER OF PIXELS | CUMULATIVE NUMBER OF PIXELS | |
|---|---|---|---|
| MARGIN | 10 | – | |
| CUT MARK | 10 | 20 | |
| IMAGE 8 | 200 | 220 | |
| CUT MARK | 10 | 230 | |
| IMAGE 7 | 200 | 430 | |
| PRELIMINARY EJECTION | 20 | – | S922 |
| CUT MARK | 10 | 440 | |
| IMAGE 6 | 200 | 200 | |
| CUT MARK | 10 | 210 | |
| IMAGE 5 | 200 | 410 | |
| CUT MARK | 10 | 420 | |
| IMAGE 4 | 200 | 620 | |
| PRELIMINARY EJECTION | 20 | – | S921 |
| CUT MARK | 10 | 630 | |
| IMAGE 3 | 200 | 200 | |
| CUT MARK | 10 | 210 | |
| IMAGE 2 | 200 | 410 | |
| CUT MARK | 10 | 420 | |
| IMAGE 1 | 200 | 620 | |
| PRELIMINARY EJECTION | 20 | – | |

FIG. 9D

| |
|---|
| PRELIMINARY EJECTION |
| IMAGE 9 |
| CUT MARK |
| IMAGE 10 |
| CUT MARK |
| PRELIMINARY EJECTION |
| IMAGE 11 |
| CUT MARK |
| IMAGE 12 |
| CUT MARK |
| IMAGE 13 |
| CUT MARK |
| PRELIMINARY EJECTION |
| IMAGE 14 |
| CUT MARK |
| IMAGE 15 |
| CUT MARK |
| IMAGE 16 |
| CUT MARK |

IMAGE FORMING APPARATUS

BACKGROUND OF THE INVENTION

1. Field of the Invention

The present invention relates to an image forming apparatus.

2. Description of the Related Art

Japanese Patent Laid-Open No. 2008-126530 discloses an image forming apparatus that forms images on both sides of a long continuous roll sheet by an inkjet system. This apparatus acquires an image of the leading edge of a sheet supplied from a sheet supply unit and determines the print positions of a plurality of subsequent images with reference to the position information thereof. The continuous sheet whose first side is printed with the plurality of images is wound in a roll, and the trailing edge at the rear of the last image printed on the first side is cut. For second-side printing, the continuous sheet is drawn out from the wound roll and is fed to a recording unit, with the cut trailing edge at the head, at which a plurality of images are printed on the second side. If there is misalignment in the sheet conveying direction between the first side and the second side when the register marks thereof are visually checked, misalignment between images on the first side and images on the second side is corrected by inputting a length for correcting the misalignment from a terminal unit to thereby correct the image recording positions.

With the configuration disclosed in Japanese Patent Laid-Open No. 2008-126530, since a plurality of images can be printed on both sides of a continuous sheet without stopping, print processing efficiency is enhanced; however, little consideration is taken to consistency in image formation on the first side and the second side, with the print quality of both sides maintained. For example, if printed sheets subjected to duplex printing are bound into a book, such as a photobook, the sheets subjected to duplex printing serve as pages that constitute the book. Thus, it is important to control processes, such as maintenance printing for maintaining image quality, to prevent the image quality from differing between pages next to each other on the front and back. Furthermore, in an apparatus configured to achieve duplex printing by printing a first side and then printing a second side, if images cannot be printed on the second side in an intended manner, the page needs to be printed again, and the sheet whose first side is printed is wasted.

SUMMARY OF THE INVENTION

The present invention provides a duplex image forming apparatus capable of printing a plurality of images on a first side and a second side of a continuous sheet while maintaining image quality.

The present invention in one aspect provides an image forming apparatus comprising an image forming unit arranged to form images on a first side and a second side of a continuous sheet; and a control unit arranged to control the image forming unit so as to form images based on image information and to form maintenance images for maintaining the image forming unit, wherein the control unit is arranged to control the image forming unit so as to form images on the second side of the sheet after forming images on the first side of the sheet, and so as to form the maintenance images on the second side at positions such that the maintenance images do not overlap with the images based on the image information formed on the first side.

According to the aspect of the present invention, a duplex image forming apparatus capable of printing a plurality of images on a first side and a second side of a continuous sheet while maintaining image quality can be provided.

Further features of the present invention will become apparent from the following description of exemplary embodiments with reference to the attached drawings.

BRIEF DESCRIPTION OF THE DRAWINGS

FIG. 6A is a flowchart of a first-side printing process.

FIG. 6B illustrates the configuration of a print-information management table.

FIG. 6C illustrates a result of printing on a roll sheet in accordance with the print-information management table in FIG. 6B.

FIG. 7A is a flowchart of a first-side printing process including maintenance printing on the first side.

FIG. 7B illustrates the configuration of a print-information management table created during execution of the process.

FIG. 7C illustrates a result of printing on a roll sheet in accordance with the print-information management table.

FIG. 9A is a flowchart illustrating a second-side printing process including maintenance printing to which the embodiment of the present invention is applied.

FIG. 9B is a second-side image-information management table created in accordance with the flowchart in FIG. 9A.

FIG. 9C is a table in which the already created first-side image-information management table is rearranged in reverse order, and the accumulated pixels are recalculated.

FIG. 9D illustrates a result of printing on a roll sheet in accordance with the print-information management table.

DESCRIPTION OF THE EMBODIMENTS

A printer that is an inkjet image forming apparatus according to an embodiment of the present invention will be described hereinbelow. The printer of this embodiment is a high-speed line printer addressed to both of one-side printing and duplex printing on a continuous roll sheet. This apparatus is suitable for the field of (professional print) apparatuses that print a large quantity of sheets used in, for example, printing companies.

Figure 1:
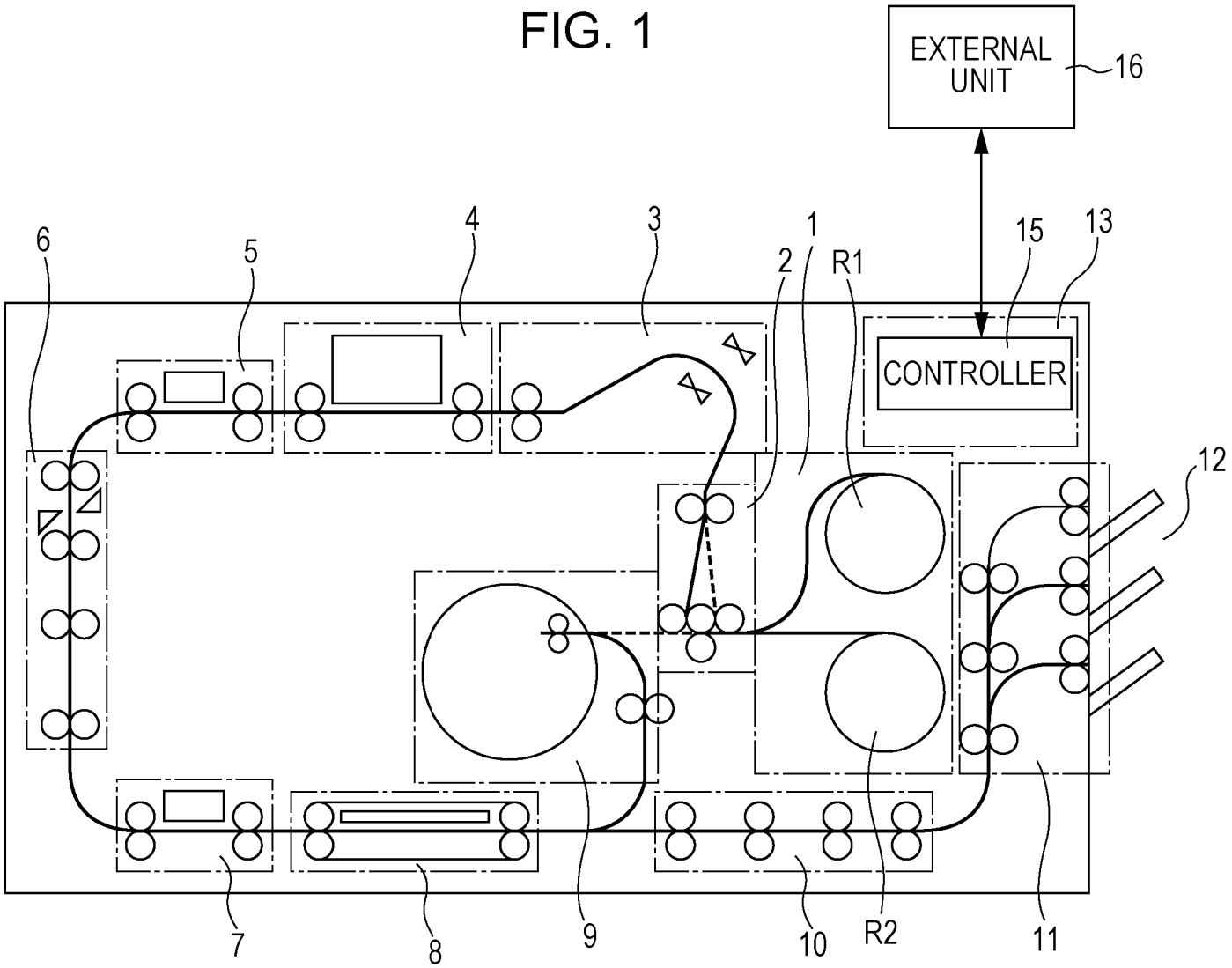
FIG. 1 is a schematic sectional view illustrating the internal configuration of a printer.

FIG. 1 is a schematic sectional view illustrating the internal configuration of the printer. The printer accommodates a sheet supply unit 1, a decurling unit 2, a skew straightening unit 3, a printing unit 4, a checking unit 5, a cutting unit 6, an information recording unit 7, a drying unit 8, a sheet winding unit 9, a discharge conveying unit 10, a sorting unit 11, a discharge tray 12, and a control unit 13. A sheet is conveyed by a conveying mechanism including roller pairs and a belt along the sheet conveying path indicated by the solid line in the drawing and is processed by the individual units.

The sheet supply unit 1 is a unit that accommodates and supplies a continuous roll sheet. The sheet supply unit 1 can accommodate two rolls R1 and R2 and is configured to selectively draw and supply a sheet. The number of rolls accommodated is not limited to two; it may be one or three or more. The decurling unit 2 is a unit that reduces the curl (warping) of a sheet supplied from the sheet supply unit 1. The decurling unit 2 reduces the curl by curving and bears down the sheet so as to give warping opposite the curl using two pinch rollers per one driving roller. The skew straightening unit 3 is a unit that straightens the skew (inclination relative to an original advancing direction) of the sheet that has passed through the decurling unit 2. The skew of the sheet is straightened by pushing a reference end of the sheet against a guide member.

The printing unit 4 is a unit that forms images on the conveyed sheet using a print head 14. The printing unit 4 further includes a plurality of conveying rollers that convey the sheet. The print head 14 has line print heads in which an inkjet nozzle array is formed in a range that covers the supposed maximum width of the sheet. The print head 14 is configured such that the plurality of print heads are arranged in parallel along the conveying direction. In this embodiment, the print head 14 has seven print heads corresponding to C (cyan), M (magenta), Y (yellow), LC (light cyan), LM (light magenta), G (gray), and K (black). The number of colors and the number of print heads are not limited to seven. The inkjet system can employ a system that uses heating elements, a system that uses piezoelectric elements, a system that uses electrostatic elements, a system that uses MEMS elements, etc. Color inks are supplied from ink tanks to the print head 14 through respective ink tubes.

The checking unit 5 is a unit that checks the state of the nozzles of the print heads, the sheet conveying state, image positions, etc. by optically reading check patterns or images printed on the sheet by the printing unit 4. The cutting unit 6 is a unit equipped with a mechanical cutter that cuts the printed sheet into a predetermined length. The cutting unit 6 also has a plurality of conveying rollers for forwarding the sheet to the next process. The information recording unit 7 is a unit that records print information, such as print serial numbers and dates, on the second side of the cut sheets. The drying unit 8 is a unit that heats the sheet printed by the printing unit 4 to dry applied ink in a short time. The drying unit 8 is also equipped with a conveying belt and conveying rollers for forwarding the sheet to the next process.

The sheet winding unit 9 is a unit that temporarily winds the continuous sheet whose first side has been printed in duplex printing. The sheet winding unit 9 is equipped with a rotating winding drum for winding the sheet. The sheet winding unit 9 is an accommodating unit that temporarily winds a continuous sheet that is subjected to first-side printing and that has not yet been cut around the winding drum and accommodates it. After the winding is completed, the winding drum rotates backward to feed the wound sheet to the decurling unit 2 and then to the printing unit 4. Since the sheet is reversed front to back, the second side can be printed by the printing unit 4. More detail of the duplex printing will be described later.

The discharge conveying unit 10 is a unit that conveys the sheets cut by the cutting unit 6 and dried by the drying unit 8 to the sorting unit 11. The sorting unit 11 is a unit that divides the printed sheets into groups and discharges them onto different trays of the discharging unit 12 as necessary. The control unit 13 is a unit that controls the components of the entire printer. The control unit 13 includes a CPU 601, a memory, a controller 15 equipped with various I/O interfaces, and a power source. The operation of the printer is controlled on the basis of an instruction from the controller 15 or an external unit 16, such as a host computer, connected to the controller 15 via an I/O interface.

Next, the basic operation of printing will be described. Since the operation of printing differs between one-side printing and duplex printing, the individual operations will be described.

Figure 2:
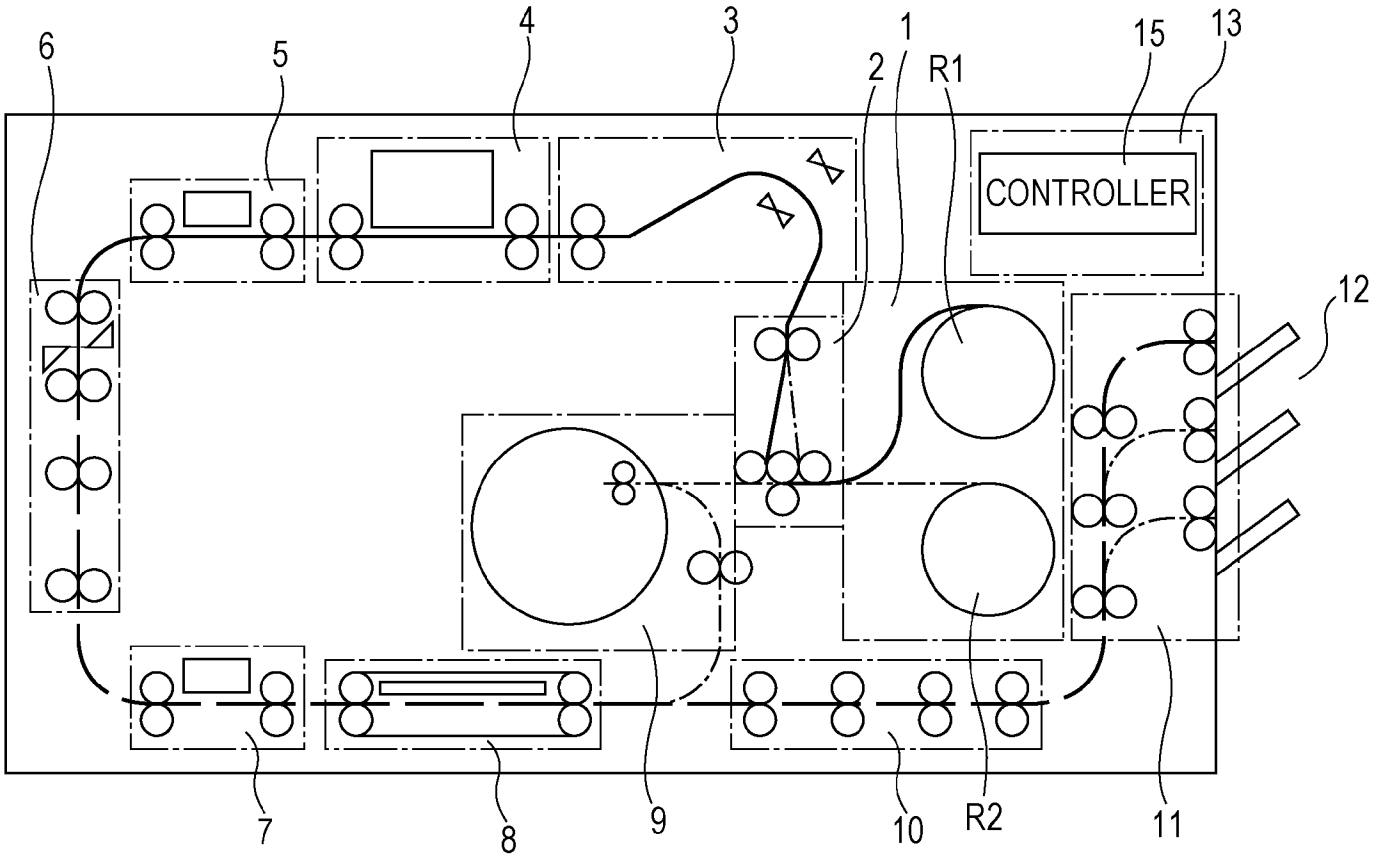
FIG. 2 is a diagram for explaining the operation of one-side printing.

FIG. 2 is a diagram for explaining the operation of one-side printing. A conveying path through which a sheet supplied from the sheet supply unit 1 is printed and is discharged to the discharging unit 12 is indicated by a bold line. The sheet supplied from the sheet supply unit 1 is processed by the decurling unit 2 and the skew straightening unit 3 and is then subjected to first-side printing by the printing unit 4. The printed sheet passes through the checking unit 5 and is cut into a predetermined unit length by the cutting unit 6. Print information is recorded on the second side of the cut sheets by the information recording unit 7 as necessary. The cut sheets are conveyed to the drying unit 8 one by one and are dried. Thereafter, the cut sheets are sequentially discharged to the discharge tray 12 of the sorting unit 11 through the discharge conveying unit 10 and are stacked thereon.

Figure 3:
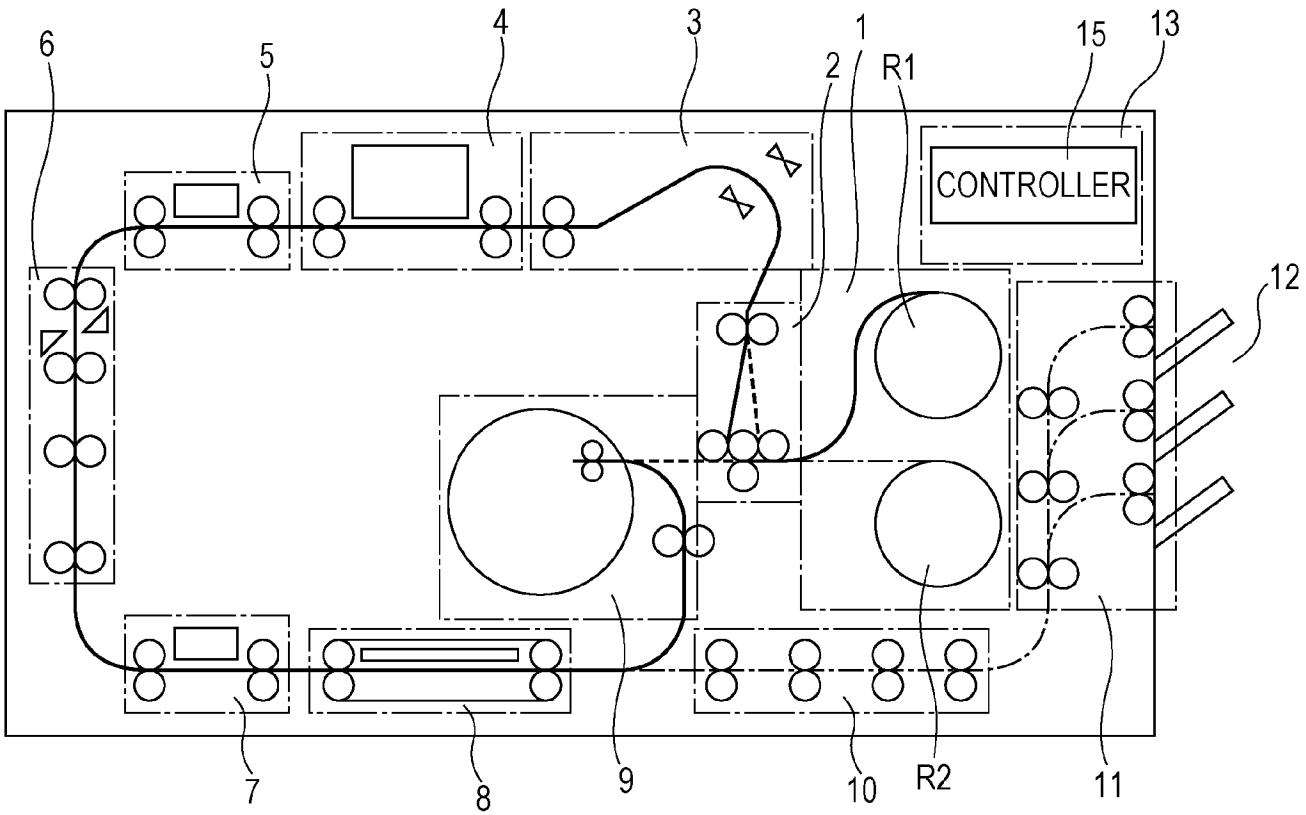
FIG. 3 is a diagram for explaining the operation of duplex printing.

FIG. 3 is a diagram for explaining the operation of duplex printing. In the duplex printing, a first-side print sequence is executed and then a second-side print sequence is executed. In the first-side print sequence, the operations from the sheet supply unit 1 to the checking unit are the same as those of the foregoing one-side printing. The continuous sheet is conveyed as it is to the drying unit 8, without being cut by the cutting unit 6. After the ink on the first side is dried by the drying unit 8, the sheet is conveyed not to the path to the discharge conveying unit but to the path to the sheet winding unit 9. The introduced sheet is wound from the leading edge around the winding drum of the sheet winding unit 9 that rotates forward (counterclockwise in the drawing). After completion of predetermined first-side printing of the recording unit 4, the trailing edge of the print region of the continuous sheet is cut by the cutting unit 6. The entire continuous sheet at the downstream side in the conveying direction (at the printed side) with reference to the cutting position passes through the drying unit 8 and is wounded to the trailing edge (cutting position) by the sheet winding unit 9 to be temporarily accommodated. On the other hand, the continuous sheet upstream of the cutting position in the conveying direction is rewound to the sheet supply unit 1 so that the leading edge (cutting position) of the sheet remains in the decurling unit 2.

After the foregoing first-side print sequence, the operation switches to the second-side print sequence. The winding drum of the sheet winding unit 9 rotates in the direction opposite to that in winding (clockwise in the drawing). The wound continuous sheet is fed to the decurling unit 2, with the trailing edge at the first-side printing (the trailing edge of the sheet at winding becomes the leading edge at the forwarding) at the head. The sheet is subjected to curl straightening in the opposite direction from the first-side print sequence by the decurling unit 2. This is because the sheet wound around the winding drum is reversed front to back from the roll in the sheet supply unit 1. Thereafter, the sheet passes through the skew straightening unit 3 and is subjected to the second-side printing of the printing unit 4. The printed sheet passes through the checking unit 5 and is cut into a predetermined unit length by the cutting unit 6. Since both sides of the cut sheet are printed, no data is recorded by the information recording unit 7. The cut sheets are conveyed to the drying unit 8 one by one and are discharged through the discharge conveying unit 10 onto the discharge tray 12 of the sorting unit 11 and are stacked thereon.

Next, the controller 15 of the thus-configured printer will be described.

Figure 4:
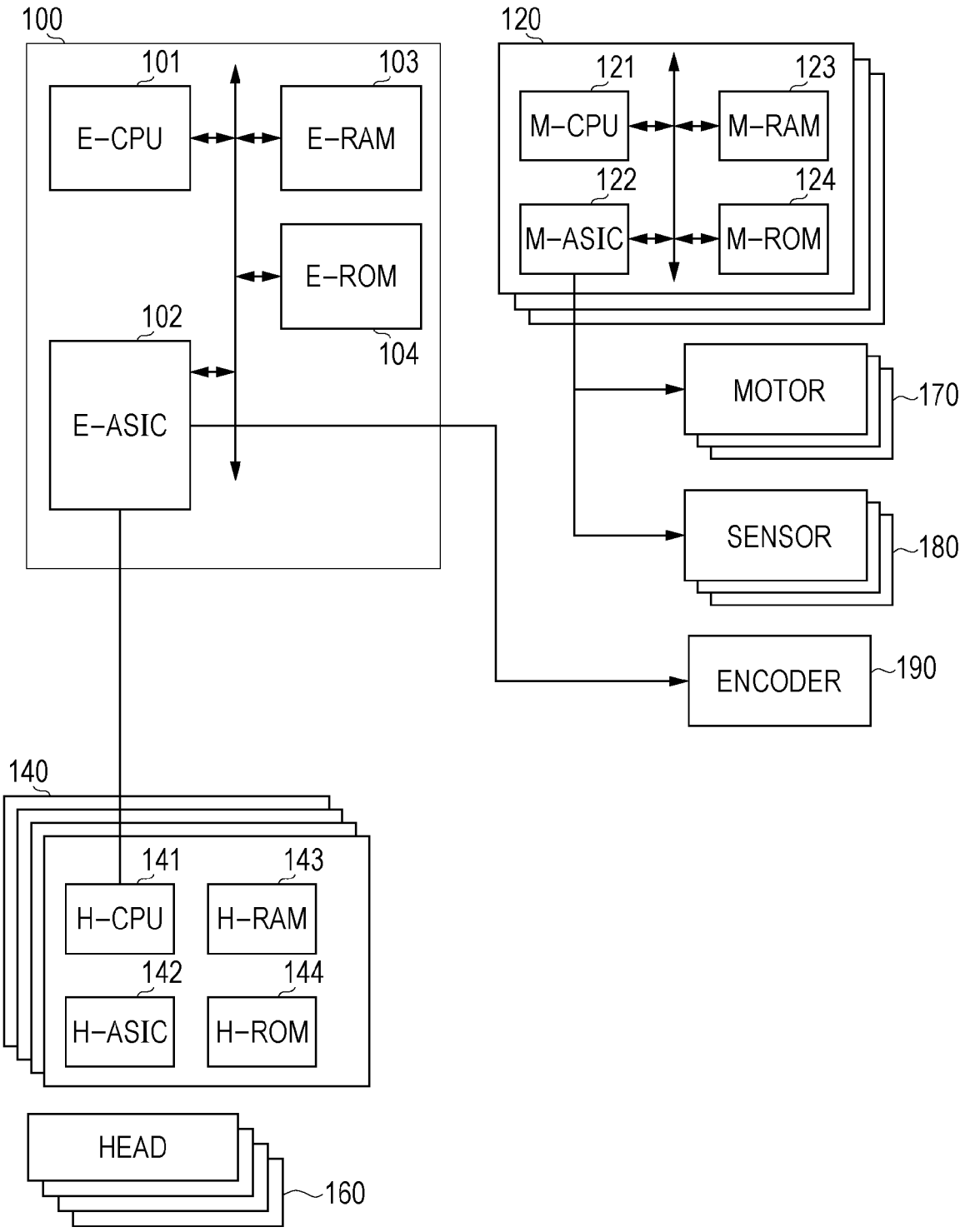
FIG. 4 is a block diagram illustrating the electrical configuration of a controller of the printer.

FIG. 4 is a block diagram illustrating the electrical configuration of the controller 15 of the printer. The controller 15 includes an engine controller 100 and a plurality of head controllers 140 and a plurality of motor controllers 120 connected to the engine controller 100. The individual head controllers 140 connect to heads 160 connected by low voltage differential signaling (LVDS). The motor controllers 120 connect to a plurality of motors 170 and sensors 180. The engine controller 100 connects to an encoder 190 that detects the position of a conveyed recording sheet. The engine controller 100 is provided with an E-CPU 101, an E-ASIC 102, an E-RAM 103, and an E-ROM 104. The motor controllers 120 are each provided with an M-CPU 121, an M-ASIC 122, an M-RAM 123, and an M-ROM 124. The head controllers 140 are each provided with an H-CPU 141, an H-ASIC 142, an H-RAM 143, and an E-ROM 144.

Figure 5:
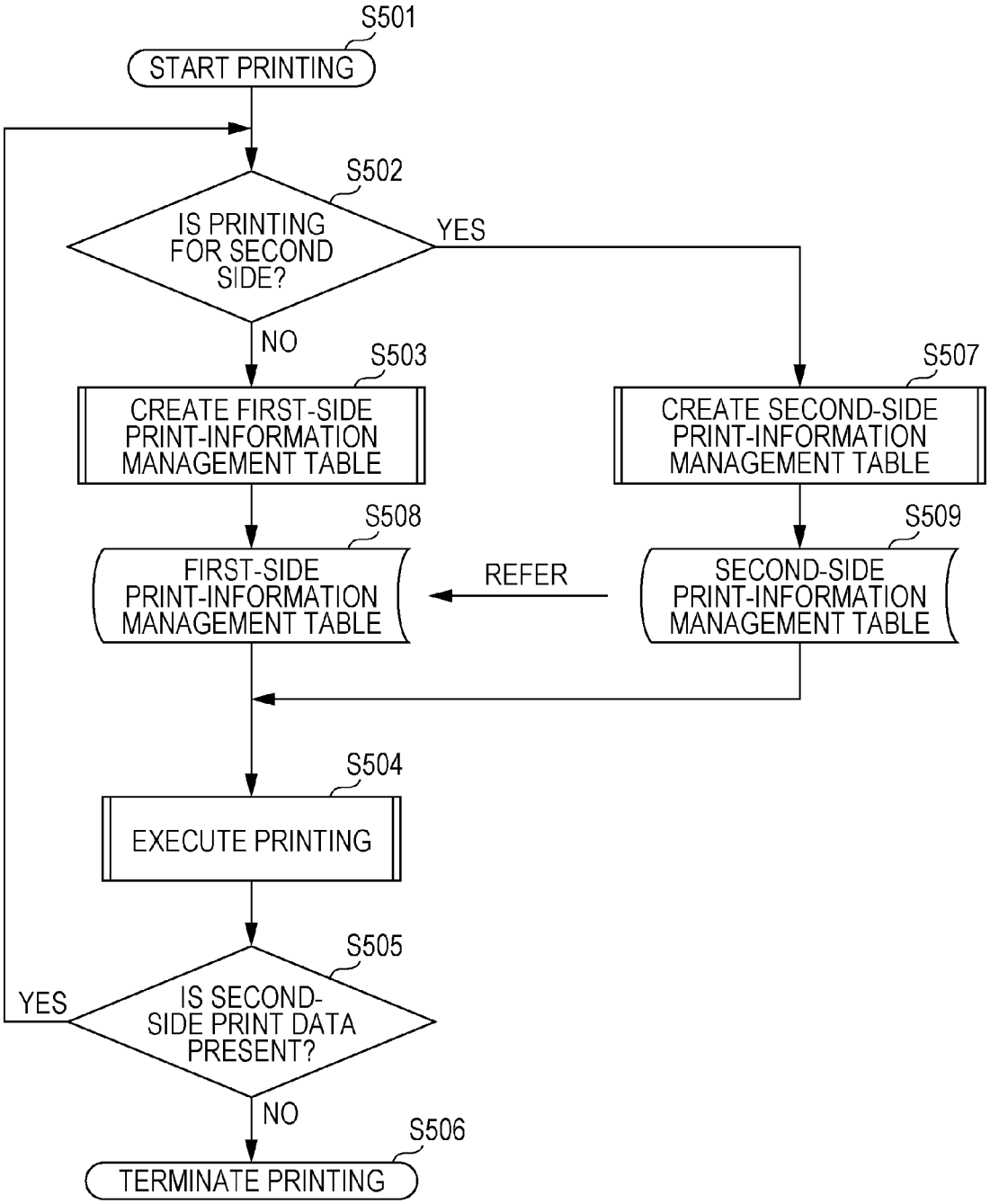
FIG. 5 is a flowchart of a printing process of an embodiment of the present invention.

FIG. 5 is a flowchart illustrating the basic operation of an embodiment of the present invention.

In step S501, when an instruction to start printing is given from the interior of the apparatus or an external unit, the E-CPU 101 of the engine controller 100 determines whether it is an instruction to print on the first side (front side) or the second side (back side) from indicated information (step S502). If it is determined in step S502 to be the front side, a print-information management table print for the first side is created in the medium E-RAM 103 that is a nonvolatile memory in accordance with the print instruction (step S503). In the process of step S503, a preliminarily ejection image between images for maintaining image quality is also recorded on the first-side print-information management table. When the first-side print-information management table is created, an instruction to start printing is given to the E-ASIC 102 to start printing (step S504). The printing is performed such that the E-ASIC 102 reads print pattern data in sequence from the first-side print-information management table in the E-RAM 103 and transfers the data to the head controller 140.

After completion of transfer of all data and the printing of the first side is completed, it is determined whether print data remains (step S505). If print data is not present, the printing is terminated (step S506). If print data is present, the process returns from step S505 to step S502. In this case, if the print data checked in step S502 indicates back-side printing, the process moves to step S507, in which a print-information management table for the second side is created. At that time, the second-side print-information management table (S509) is created with reference to the first-side print-information management table created in step S503 (S508). From then on, the process moves to step S504, step S505, and step S506 in accordance with the created second-side print-information management table, and the back-side printing is terminated.

FIG. 6A is a flowchart of the first-side printing process in the case where maintenance printing is not performed for describing the details of an embodiment of the present invention. The flowchart in FIG. 6A corresponds to the processes in steps S503 and S504 in FIG. 5. FIG. 6B illustrates the configuration of a print-information management table created during execution of the process. FIG. 6C illustrates a result of printing on a roll sheet in accordance with the print-information management table in FIG. 6B.

For ease of explanation, this example will be described using a case in which eight images (e.g. page images) of the same size constituted by 200 pixels in the conveying direction are printed. First, when a print instruction is given in step S611, reception of image data is started (step S612). When reception of one item of image data (e.g. one page of image data) is completed, the process of registering the type of print pattern (in this case, image type) and the pattern size (200 pixels) into the print-information management table is performed (step S613).

After the registration of the images is completed, a pattern for control, referred to as a cut mark, is registered. The cut mark serves as a trigger for activating a sheet cutting mechanism for cutting the images into unit pages. Also for the cut-mark information, the type of print pattern (in this case, cut mark) and the pattern size (10 pixels) are registered in the print-information management table, like the images (step S614). By repeating this process until no image data remains, the print-information management table shown in FIG. 6B is finally constituted.

Next, the E-ASIC 102 reads print pattern data in sequence from the print-information management table in the E-RAM 103 and transfers the data to the head controller 140, thereby executing printing. The print result is shown in FIG. 6C. The pattern sizes of the images and the cut marks are merely taken as examples and are not limited thereto.

FIG. 7A is a flowchart of a printing process for the first side in which preliminary ejection pattern printing, that is one of maintenance printings, is added to the process in FIG. 6A. The preliminary ejection pattern (exemplifying a maintenance image, which may be a maintenance pattern) printing here is an ejecting operation for ensuring print quality in inkjet printers etc., in which ink is ejected through nozzles at regular intervals or in a predetermined distance on a continuous sheet, such as a roll sheet. This is a maintenance operation for maintaining the ink in the nozzles under the best condition so that even if the nozzles are not used for a while, printing can be performed without degrading the quality. The quality of print images can be maintained by performing preliminary ejection between the images every time. However, since excessive preliminary ejection pattern printing results in an increase in ink consumption and an increase in waste paper, it is generally implemented at the minimum. Accordingly, the preliminary ejection is performed such that the time interval from a preceding preliminary ejection to the next preliminary ejection is within a predetermined time or the distance between images formed by the preliminary ejection is within a predetermined distance.

The flowchart shown in FIG. 7A is obtained by adding a preliminary ejection pattern process to the flowchart in FIG. 6A and corresponds to the processes in steps S503 and S504 in FIG. 5, as in FIG. 6A. FIG. 7B illustrates the configuration of a print-information management table created during execution of the process. FIG. 7C illustrates a result of printing on a roll sheet in accordance with the print-information management table.

For ease of explanation, this example will be described using a case in which eight images of the same size constituted by 200 pixels in the conveying direction are printed. First, when a print instruction is given in step S711 of FIG. 7A, preliminary ejection data, for ensuring the (quality of the) first image, is unconditionally registered in the print-information management table (step S712). Next, reception of image is started (step S713). When reception of one item of image data is completed, it is determined whether preliminary ejection is needed (step S714). In this printing system, for example, the condition that preliminary ejection is performed once in a conveying distance of 700 pixels is set. If the sum of the number of cumulated pixels and the number of pixels of an image 1 (200 pixels) in the image-information management table does not exceed 700 under this condition, it is determined that preliminary ejection is not needed. In this case, the process moves to step S716, in which the type of print pattern (in this case, image type) and the pattern size (200 pixels) are registered in the print-information management table. The print-information management table also stores and manages, in addition to the types of individual image patterns and the pattern sizes, the number of cumulated pixels as cumulative length information from the preceding preliminarily ejection image. After the registration of print images is completed, cut trigger patterns, referred to as cut marks for cutting the individual images into unit pages, for activating the sheet cutting mechanism are printed. For the cut mark information, like images, the type of print pattern (in this case, a cut mark) and the pattern size (10 pixels) are registered in the print-information management table, and the number of cumulated pixels is also updated (step S717). When this process is repeated, in the example of FIG. 7B, the number of cumulated pixels of the cut mark directly after an image 3 becomes 630, and when an image 4 of 200 pixels is next recorded, the number of cumulated pixels exceeds 700. Thus, in step S715 after reception of the image 4 is completed, it is determined that preliminary ejection is needed, so that the process of registering preliminary ejection data into the image-information management table is performed (step S715*a*). In step S715*a*, like images and cut marks, the type of print pattern (in this case, the type of preliminary ejection) and the pattern size (20 pixels) are registered in S721 of the print-information management table in FIG. 7B. The number of cumulated lines is set to 0 because of preliminary ejection. This process is repeated until no image data remains to thereby finally constitute the print-information management table shown in FIG. 7B.

Thus, the print-information management table includes print-information management information including the type of image pattern, pattern size, and number of cumulated pixels (cumulative length information) for printing images, printing cut marks for control, and maintenance printing, such as preliminary ejection.

Next, the E-ASIC 102 reads print pattern data in sequence from the print-information management table in the E-RAM 103 and transfers the data to the head controller 140, thereby executing printing. The print result is shown in FIG. 7C. The pattern sizes of the images and the cut marks are merely taken as examples and are not limited thereto. Furthermore, the distance necessary for preliminary ejection depends on the environment and is not limited to the values used in description.

Figure 8:
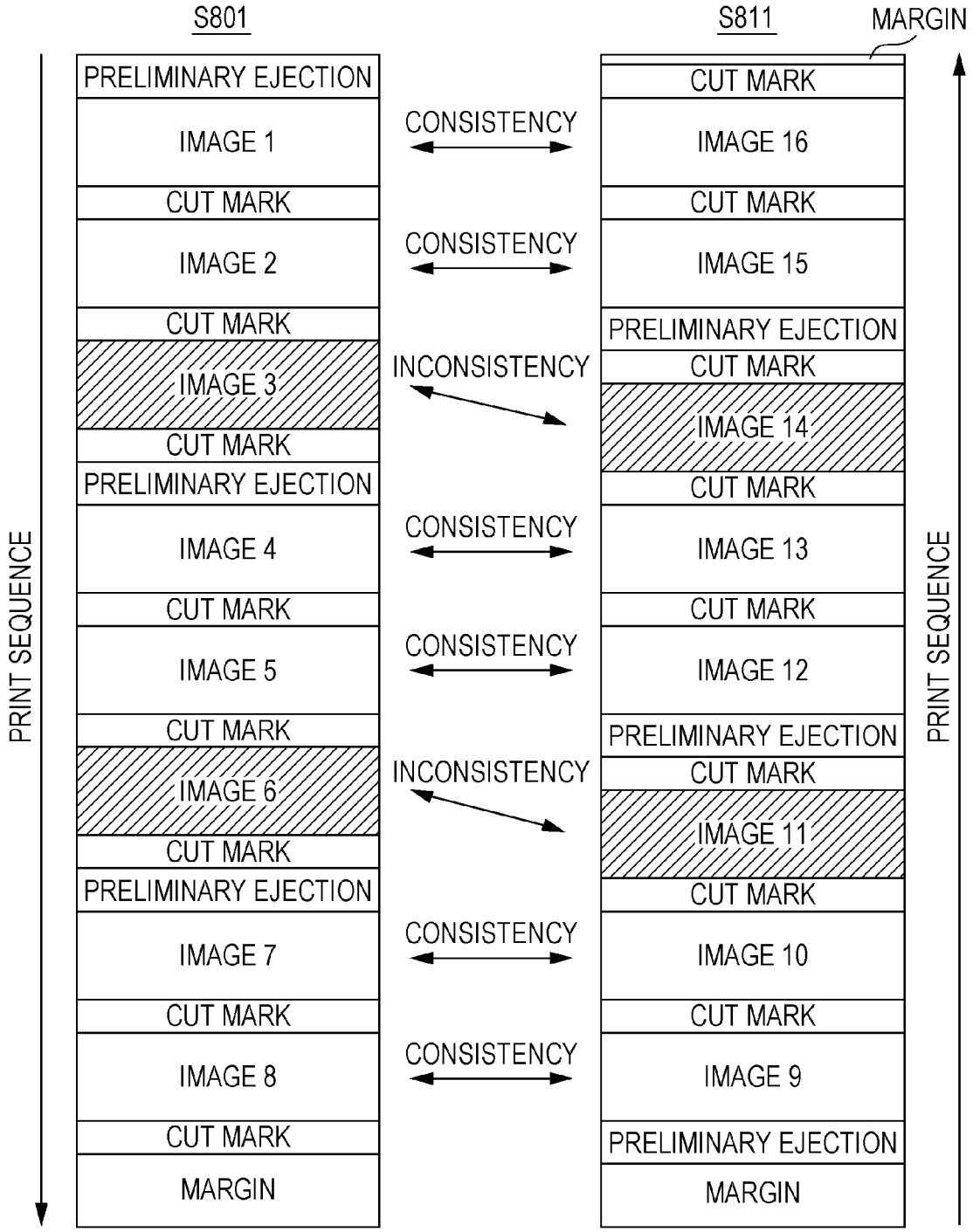
FIG. 8 illustrates patterns before the embodiment of the present invention is applied.

FIG. 8 illustrates the result of duplex printing in the case where the process described using FIGS. 7A to 7C is applied to second-side printing. Here, it is assumed that 16 items of image data are printed on eight sheets. Reference numeral S801 denotes the result of first-side printing, in which eight image data patterns, preliminary ejection patterns, and cut mark patterns are developed. The printing flows from the top to the bottom as viewed from the front of the drawing. Since the second-side printing is started from the trailing edge of the first side because of the configuration of this system, the second-side printing results as in S811. However, the second-side printing flows from the bottom to the top as viewed from the front in the drawing. Although a margin is placed at the end of the first-side printing to serve as a second-side-printing start position, a detailed description thereof will be omitted because it is not the core of this embodiment.

Comparison between the print data S801 and S811 shows that images 3 and 14 and images 6 and 11 that do not have consistency between the first side and the second side are generated (so images 3 and 14 and 6 and 11 are not positioned consistently with each other). This significantly reduces efficiency in terms of waste sheets and ink consumption.

To cope with such a situation, according to an embodiment of the present invention, the same conditions as for the first side are not applied to the second side to determine whether preliminary ejection data is needed, and the printed first-side-print-information management table is used, as shown in FIGS. 9A to 9C. FIG. 9A is a flowchart illustrating the second-side printing process. FIG. 9C is a table in which the already created first-side image-information management table is rearranged in reverse order, and the accumulated pixels are recalculated. FIG. 9B is a second-side image-information management table created in accordance with the flowchart in FIG. 9A.

For ease of explanation, this example will also be described using a case in which eight images of the same size constituted by 200 pixels in the conveying direction are printed on the second side. First, when a print instruction is given in step S911 of the flowchart in FIG. 9A, preliminary ejection data for ensuring the first image is unconditionally registered in the print-information management table (step S912). Next, reception of second-side image data is started (step S913). When reception of one item of image data is completed, it is determined whether preliminary ejection is needed (step S914). Here, a process after the data of an image 11 has been received will be described. After the image 11 has been received and disposed following the cut mark behind the image 10, the number of cumulated pixels becomes 440+200 (data of the image 11)=640. The number of cumulated pixels of the image 6 corresponding to the front side of the image 11 on the table in FIG. 9C that is obtained by recalculating the first-side image-information management table is 200, so that the cumulated pixels are inconsistent. Next, it is determined what print pattern is provided following the cut mark next to the image 6 of the front side.

In this case, the next pattern is a preliminary ejection pattern S922, which shows that a preliminary ejection pattern has been printed on the first side. Even if the cut mark, the image 11, and the cut mark are printed following the image 10, the number of cumulated pixels up to the cut mark is 650, which does not exceed 700, and thus, there is no need to perform preliminary ejection in front of the image 11 to maintain the image quality. However, even if the second side does not satisfy the condition for preliminary ejection, the arrangement of the images is made consistent between the first side and the second side by disposing a preliminary ejection pattern on the second side, provided that the first side has the preliminary ejection pattern. This makes it possible to prevent inconsistency between the images 6 and 11, as shown in FIG. 8. The inconsistency between the image 3 and the image 14 in FIG. 8 can also be continuously prevented by checking the number of cumulated pixels of S930 and S920 and the pattern of S921 in this way. By repeating this process until no image data remains, the print-information management table shown in FIG. 9B is constituted.

Next, the E-ASIC 102 reads print pattern data in sequence from the print-information management table in the E-RAM 103 and transfers the data to the head controller 140, thereby executing printing. The print result is shown in FIG. 9D. The pattern sizes of the images and the cut marks are merely examples and are not limited thereto.

Figure 10:
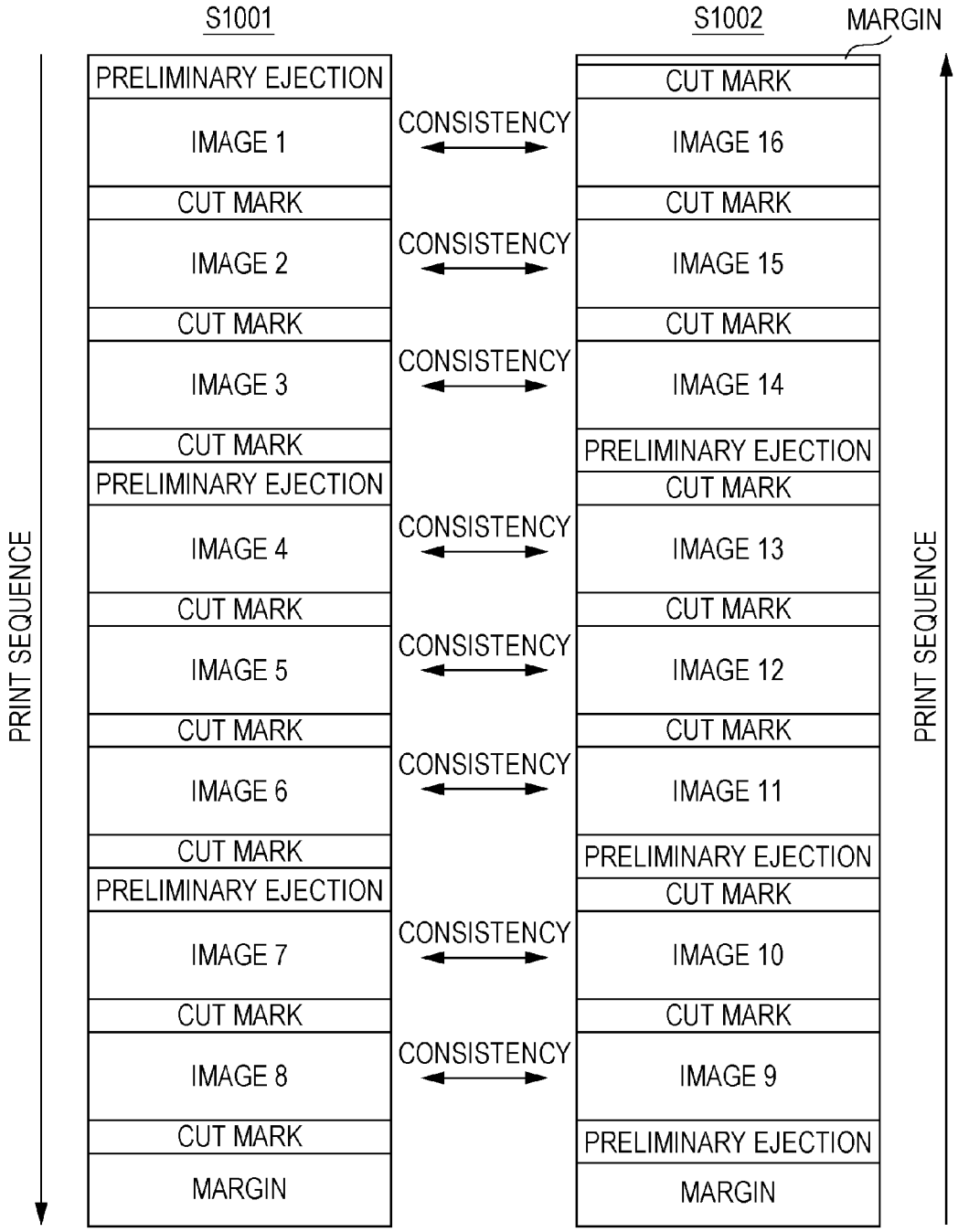
FIG. 10 illustrates patterns when the embodiment of the present invention is applied.

FIG. 10 illustrates patterns disposed on the first and second sides of the continuous sheet as a result of the process. Here, it is also assumed that, as in FIG. 8, of 16 images based on image data, eight images are printed on the first side, and the remaining eight images are printed on the second side, which are then cut into eight duplex prints. Reference numeral S1001 denotes the result of first-side printing, in which eight image data patterns, preliminary ejection patterns, and cut mark patterns are printed in sequence from the top. Since the second-side printing is started from the trailing edge of the first side because of the configuration of this system, the second-side printing results as in S1002. The second-side printing flows from the bottom to the top. Each image on the first side is positioned consistently with the correspondent image on the second side. Preferably each image on the first side fully overlaps with the correspondent image on the second side. Each area consisting of a preliminary ejection pattern and its adjacent cut mark pattern on the first side is also positioned consistently with an area consisting of a preliminary ejection pattern and its adjacent cut mark pattern on the second side. The images do not overlap with preliminary ejection patterns or cut mark patterns. Furthermore, the trailing edge of the first side also serves as a second-side printing start position, and a margin is placed at the trailing end of the first side to perform preliminary ejection; however, a detailed description thereof will be omitted because it is not the core of this embodiment.

Comparison between the print data S1001 and S1002 shows that there is no overlap (partial or full) between the maintenance images on the second side and the images on the first side. The images between the first side and the second side are consistent (positioned consistently with each other), thus remarkably improving the efficiency, in terms of waste sheets and ink consumption, as compared with that in FIG. 8.

This embodiment has been described with the preliminary ejection operation, as an example, for maintaining the condition of ink in the nozzles of an inkjet printer in an optimum condition. The present invention can be applied to any maintenance printing for maintaining printers in a good condition, such as nonejection-detection pattern printing for detecting nonejection of nozzles in use, in addition to the preliminary ejection operation; this embodiment is not limited to the preliminary ejection operation. The number of cumulated pixels in this embodiment is one of position information indicating a distance from a preceding preliminary ejection pattern image. Instead of the number of cumulated pixels, it is also possible to acquire position information, such as distances of the individual maintenance images from the leading edge of the first side and to determine positions at which second-side maintenance images are to be inserted using the position information.

According to this embodiment, at duplex printing on a long sheet, such as a roll sheet, the timing at which maintenance images are inserted on the first side is calculated from a process specification for maintaining image quality. For example, maintenance images are printed so that the distance between the maintenance images is within a predetermined distance or the interval at which maintenance images are printed is within a predetermined time.

In contrast, for the second side, maintenance-image insertion timing is calculated from information on the positions and sizes of the maintenance images on the first side. This offers the advantage of reducing waste sheets at duplex printing while maintaining the quality of images printed on the first side and the second side.

To achieve such efficient printing, first, this embodiment is provided with an image-information storage unit (E-RAM 103) that stores image information on images printed on the first side in duplex printing (for example, the image size in the main scanning direction and position information of print images and maintenance images). Information, such as the arrangement of print images and maintenance images on the first side, is acquired from the image-information storage unit. Using this information allows efficient printing while maintaining the image quality by determining whether to insert maintenance images during second-side printing.

The present invention also provides an image forming apparatus comprising a supply unit that accommodates a continuous rolled sheet and supplies the continuous rolled sheet; a printing unit that prints images on the continuous sheet supplied from the supply unit; and an accommodating unit that winds the continuous sheet from the leading edge to accommodate the continuous sheet after printing of images on the first side is completed or while the images are printed, wherein the continuous sheet accommodated in the accommodating unit is drawn out from the accommodating unit and is fed to the printing unit, with the trailing edge of the first side at the head, and the second side is printed by the printing unit; the image forming apparatus includes a print information management unit arranged to generate manage first side print information including information about positions on the first side at which images based on image data and, maintenance images; and wherein the print information management unit generates second side print information including information about positions on the second side at which images based on image date and maintenance images are formed while referring to the first side print information.

The print information management unit can store first side print information in a memory.

The first side print information can include lengths in a main scanning direction of an area on which plurality of images based on image information are formed continuously; and when the first side print information is generated, it is determined from the information the about length in the main scanning direction of the area whether forming of an maintenance image is needed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-120745 filed on May 26, 2010, which is hereby incorporated by reference herein in its entirety.

What is claimed is:

1. A method for controlling an apparatus having an inkjet head for duplex printing, the method comprising:

arranging maintenance images among page images prior to printing based on a predetermined condition;

causing the apparatus to print a plurality of image patterns in sequence on a first side of a continuous sheet, wherein the plurality of image patterns includes the page images and the maintenance images that have been arranged among the page images prior to printing based on the predetermined condition;

causing the apparatus to determine, based on a first side print schedule for printing on the first side of the continuous sheet, a second side print schedule for printing on a second side of the continuous sheet, wherein the second side print schedule is used for printing the plurality of image patterns including the page images and the maintenance images that have been arranged among the page images prior to printing based on the predetermined condition; and causing the apparatus to print a plurality of image patterns in sequence on the second side of the continuous sheet based on the determined second side print schedule after printing the plurality of image patterns on the first side of the continuous sheet, wherein, a second side maintenance image located between one of the page images and a next one of the page images does not overlap with a page image printed on the first side of the continuous sheet, and wherein, a first side maintenance image located between one of the page images and a next one of the page images does not overlap with a page image printed on the second side of the continuous sheet.

2. The method according to claim 1, further comprising:

causing the apparatus to print a cut mark on the second side between each one of the page images and next one of the page images; and causing the apparatus to cut the continuous sheet at each cut mark.

3. The method according to claim 2, wherein the first side maintenance image overlaps, partially or wholly, with at least one of an area of which an opposite side corresponds to the second side maintenance image and an area of which an opposite side the cut mark is printed on the second side.

4. The method according to claim 1, wherein on the first side and the second side, a distance between adjacent maintenance images is within a predetermined distance.

5. The method according to claim 1, wherein each image pattern printed on the first side and the second side is positioned consistently with each other.

6. The method according to claim 1, further comprising causing the apparatus to print a mark on the first side between each first page image and second page image, wherein the second side maintenance image overlaps, partially or wholly, with at least one of an area of which an opposite side corresponds to the first side maintenance image and an area of which an opposite side the mark is printed on the first side.

7. The method according to claim 1, wherein the first side maintenance image partially or wholly overlaps with an area of which an opposite side corresponds to the second side maintenance image.

8. The method according to claim 1, further comprising:

causing the apparatus to wind the continuous sheet on which the image patterns have been printed on the first side by the inkjet head; and then causing the apparatus to unwind the wound continuous sheet for reversing the continuous sheet, wherein the reversed continuous sheet is subjected to be printed on the second side by the inkjet head.

9. The method according to claim 8, wherein the continuous sheet is accommodated as a rolled sheet before printing.

10. The method according to claim 1, wherein a maintenance operation that prints a maintenance image is at least one of a preliminary ejection of the inkjet head for maintaining conditions of nozzles in the inkjet head, and printing inspection patterns for detecting non-ejection nozzles in the inkjet head.

11. A method for controlling an apparatus having an inkjet head for duplex printing, the method comprising:

arranging maintenance images among page images prior to printing based on a predetermined condition;

causing the apparatus to print a plurality of image patterns in sequence on a first side of a continuous sheet, wherein the plurality of image patterns includes the page images and the maintenance images that have been arranged among the page images prior to printing based on the predetermined condition;

causing the apparatus to determine, based on a first side print schedule for printing on the first side of the continuous sheet, a second side print schedule for printing on a second side of the continuous sheet, wherein the second side print schedule is used for printing the plurality of image patterns including the page images and the maintenance images that have been arranged among the page images prior to printing based on the predetermined condition; and causing the apparatus to print a plurality of image patterns in sequence on the second side of the continuous sheet based on the determined second side print schedule after printing the plurality of image patterns on the first side of the continuous sheet, wherein a first side maintenance image located between one of the page images and a next one of the page images partially or wholly includes an area of which an opposite side corresponds to a second side maintenance image located between one of the page images and a next one of the page images of the continuous sheet.

12. The method according to claim 11, wherein a maintenance operation that prints a maintenance image is at least one of a preliminary ejection of the inkjet head for maintaining conditions of nozzles in the inkjet head, and printing inspection patterns for detecting non-ejection nozzles in the inkjet head.

13. The method according to claim 12, wherein a time interval from a preceding preliminary ejection to a next preliminary ejection is within a predetermined time.

14. The method according to claim 12, wherein a distance between images printed by the preliminary ejection is within a predetermined distance.

15. An apparatus having an inkjet head for duplex printing, the apparatus comprising:

an image printing unit configured to use the inkjet head to print image patterns on a first side and a second side of a continuous sheet;

a first determining unit configure to determine a first side print schedule for printing on the first side of the continuous sheet, wherein the first side print schedule is used for printing a plurality of image patterns including page images and maintenance images, and the maintenance images are arranged among the page images based on a predetermined condition;

a second determining unit configured to determine, based on the first side print schedule for printing on the first side of the continuous sheet, a second side print schedule for printing on the second side of the continuous sheet, wherein the second side print schedule is used for printing the plurality of image patterns including the page images and the maintenance images that have been arranged among the page images prior to printing based on the predetermined condition; and a control unit configured to cause the image printing unit to print the plurality of image patterns on the first side of the continuous sheet based on the first side print schedule, and to print the plurality of image patterns on the second side of the continuous sheet based on the second side print schedule, wherein the control unit causes the image printing unit to print the plurality of image patterns on the second side of the continuous sheet after printing the plurality of image patterns on the first side of the continuous sheet such that, the maintenance images are printed on the second side of the continuous sheet at positions that do not overlap with the page images printed on the first side of the continuous sheet.

16. The apparatus according to claim 15, further comprising a receiving unit configured to receive a print instruction having print data wherein, in response to the receiving unit receiving the print instruction, preliminary ejection data, for ensuring quality of a first page image, is unconditionally registered in the registered information before reception of image data is started, and wherein the predetermined condition is one of a time interval from a preceding preliminary ejection to a next preliminary ejection image and a distance between image patterns printed by the preliminary ejection.

17. The apparatus according to claim 15, wherein the predetermined condition includes cumulative length information up to each image pattern as accumulated from each preceding maintenance image pattern, and wherein, the first determining unit determines the first side print schedule, in response to cumulative length information from a preceding maintenance image pattern exceeding a predetermined distance, so that the maintenance images are arranged among the page images.

18. The apparatus according to claim 17, wherein the first determination unit determines the first side print schedule by resetting the cumulative length information to zero such that a size of the maintenance image pattern is not added to the cumulative length information, and wherein the maintenance image is at least one of a preliminary ejection of the inkjet head for maintaining conditions of nozzles in the inkjet head, and printing inspection patterns for detecting non-ejection nozzles in the inkjet head.

19. The apparatus according to claim 15, wherein the second determining unit determines the second side print schedule for printing on the second side of the continuous sheet by using a second predetermined condition that is not the same as the predetermined condition used by the first determining unit to determine the first side print schedule for the first side of the continuous sheet.

20. The apparatus according to claim 19, wherein, after the first determination unit determines all first-side print schedules, the control unit rearranges the first-side print schedules in reverse order and recalculates the cumulative length information.

21. The apparatus according to claim 19, wherein the second determining unit determines the second side print schedule for printing on the second side of the continuous sheet by using the first-side print schedule for printing on the first side of the continuous sheet such that, when printed sheets subjected to duplex printing are bound into a bound material, difference between image quality of sheets that face each other in the bound material is minimized.

22. The apparatus according to claim 15, further comprising a register unit configured to register the first side print schedule in a print-information management table, wherein the registered first side print schedule includes an image pattern, an image pattern size of each image pattern, and cumulative length information up to each image pattern as accumulated from each preceding maintenance image pattern.

23. A method for controlling an apparatus for duplex printing, the method comprising:

causing the apparatus to print a plurality of image patterns on a first surface of a continuous sheet, wherein the plurality of image patterns on the first surface of a continuous sheet includes first surface page images and first surface maintenance images that are arranged among the first surface page images, wherein a maintenance image is printed among the first surface page images on the first surface of the continuous sheet in a case where a predetermined condition is satisfied; and causing the apparatus to print a plurality of image patterns on a second surface of the continuous sheet after printing the plurality of image patterns on the first surface of the continuous sheet, wherein the plurality of image patterns on the second surface of the continuous sheet includes second surface page images and second surface maintenance images that are arranged among the second surface page images, wherein a second surface maintenance image located between one of the second surface page images and a next one of the second surface page images does not overlap with a first surface page image printed on the first surface of the continuous sheet, and wherein a first surface maintenance image located between one of the first surface page images and a next one of the first surface page images does not overlap with a second surface page image printed on the second surface of the continuous sheet, and wherein printing of the second surface of the continuous sheet is started from a trailing side of the first surface.

24. An apparatus for duplex printing, the apparatus comprising:

a print control unit configured to cause a printing unit to print plurality of image patterns on a first surface of a continuous sheet and to print a plurality of image patterns on a second surface of the continuous sheet after printing the plurality of image patterns on the first surface of the continuous sheet, wherein the plurality of image patterns on the first surface of a continuous sheet includes first surface page images and first surface maintenance images that are arranged among the first surface page images, and the plurality of image patterns on the second surface of the continuous sheet includes second surface page images and second surface maintenance images that are arranged among the second surface page image, wherein a maintenance image is printed among the first surface page images on the first surface of the continuous sheet in a case where a predetermined condition is satisfied, wherein a second surface maintenance image located between one of the second surface page images and a next one of the second surface page images does not overlap with a page image printed on the first surface of the continuous sheet, and wherein a first surface maintenance image located between one of the first surface page images and a next one of the first surface page images does not overlap with a page image printed on the second surface of the continuous sheet, and wherein the control unit causes the printing unit to print the plurality of images on the second surface of the continuous sheet such that printing of the second surface of the continuous sheet is started from a trailing side of the first surface.

25. The apparatus according to claim 24, wherein a maintenance pattern is printed such that a time interval from a preceding printing of a maintenance pattern to a next printing of a maintenance pattern is within a predetermined time or a distance between maintenance images formed by printing is within a predetermined distance.

26. The apparatus according to claim 24, wherein maintenance patterns are printed on the second surface of the continuous sheet based on first surface print information including information about positions of the page images and the maintenance images on the first surface of the continuous sheet.

27. The apparatus according to claim 24, further comprising a generation unit configure to generate a first surface print schedule for printing on the first surface of the continuous sheet and a second surface print schedule for printing on the second surface of the continuous sheet, wherein each of the first surface print schedule and the second surface print schedule is used for printing the plurality of image patterns including page images and maintenance images, wherein the generation unit generates the second surface print schedule with reference to the first surface print schedule, and wherein the control unit causes the printing unit to print the plurality of image patterns on the first surface of the continuous sheet based on the first surface print schedule, and to print the plurality of image patterns on the second surface of the continuous sheet based on the second surface print schedule.

28. The apparatus according to claim 24, wherein a maintenance image is printed among the page images on the second surface of the continuous sheet based on a first surface print information.

29. The apparatus according to claim 24, wherein, even if the predetermined condition is not satisfied, a maintenance image is printed among the page images on the second surface of the continuous sheet based on whether a maintenance image is printed on the first second surface of the continuous sheet.

30. The apparatus according to claim 24, wherein the printing unit has an inkjet head.

* * * * *